US009729992B1

(12) United States Patent
Holman

(10) Patent No.: US 9,729,992 B1
(45) Date of Patent: Aug. 8, 2017

(54) FRONT LOUDSPEAKER DIRECTIVITY FOR SURROUND SOUND SYSTEMS

(71) Applicant: Tomlinson M. Holman, Yucca Valley, CA (US)

(72) Inventor: Tomlinson M. Holman, Yucca Valley, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/210,169

(22) Filed: Mar. 13, 2014

Related U.S. Application Data

(60) Provisional application No. 61/784,330, filed on Mar. 14, 2013.

(51) Int. Cl.

| | |
|---|---|
| ***H04R 5/00*** | (2006.01) |
| ***H04S 5/02*** | (2006.01) |
| ***H04R 29/00*** | (2006.01) |
| ***H04S 3/00*** | (2006.01) |
| ***H04R 5/02*** | (2006.01) |

(52) U.S. Cl.
CPC ..... *H04S 5/02* (2013.01); *H04R 5/02* (2013.01); *H04R 29/001* (2013.01); *H04S 3/00* (2013.01)

(58) Field of Classification Search
None
See application file for complete search history.

(56) References Cited

U.S. PATENT DOCUMENTS

| | | | | |
|---|---|---|---|---|
| 7,418,104 | B2 | 8/2008 | Spinale | |
| 8,155,323 | B2 | 4/2012 | Chabanne | |
| 8,184,834 | B2 | 5/2012 | Oh et al. | |
| 2006/0050907 | A1 | 3/2006 | Levitsky | |
| 2007/0104331 | A1 | 5/2007 | Sawashi et al. | |
| 2007/0217621 | A1* | 9/2007 | Takumai | H04R 3/12 381/80 |
| 2007/0230724 | A1* | 10/2007 | Konagai | H04R 3/12 381/303 |
| 2009/0157575 | A1 | 6/2009 | Schobben et al. | |
| 2010/0128880 | A1 | 5/2010 | Scholz | |

OTHER PUBLICATIONS

Strauch, Joel. "Dolby Speakers: 5.1 Channels, and Everything's on." *PCWorld* (Oct. 30, 2000). 2 Pages. http://www.pcworld.com/article/33442/article.html.

* cited by examiner

*Primary Examiner* — Muhammad N Edun
(74) *Attorney, Agent, or Firm* — Blakely, Sokoloff, Taylor & Zafman LLP

(57) ABSTRACT

An audio receiver that receives left, right, and center audio channels for a piece of sound program content is described. A content processor in the audio receiver generates separate audio signals corresponding to each channel for driving corresponding transducers in left and right loudspeaker arrays. The content processor generates (1) first center audio signals for driving transducers in the left array to generate a first center pattern, (2) second center audio signals for driving transducers in the right array to generate a second center pattern, (3) left audio signals for driving transducers in the left array to generate a left pattern, and (4) right audio signals for driving transducers in the right array to generate a right pattern. The first and second center patterns collectively represent the center channel while the left and right patterns respectively represent the left and right channels.

20 Claims, 8 Drawing Sheets

FRONT LOUDSPEAKER DIRECTIVITY FOR SURROUND SOUND SYSTEMS

RELATED MATTERS

This application claims the benefit of the earlier filing date of U.S. provisional application No. 61/784,330, filed Mar. 14, 2013.

FIELD

A system for reproducing a stabilized phantom center audio channel using left and right speaker arrays by separately controlling the directivity of audio signals representing the left and right channels on the one hand, and the phantom center audio channel on the other hand provided to the left and right speaker arrays. Other embodiments are also described.

BACKGROUND

In cinema and many home theater systems, sound for front left and front right audio channels is produced by corresponding speakers located respectively to the left and the right sides of a screen or display. Although they may be located outside the screen's boundaries, these front left and right speakers may produce left and right channels with reasonable angular accuracy.

However, a major hurdle for rear-energized or flat video displays is the lack of space for a front center channel speaker coincident with the center of the video display. To accommodate this lack of space, front center speakers have been placed above and/or below the video display. However, since a speaker placed above or below the display is also not coincident with the center of the display, the center channel sound may appear too high or too low.

SUMMARY

In one embodiment of the invention, an audio receiver receives a left audio channel, a right audio channel, and a center audio channel for a piece of sound program content. A content processor generates separate sets of audio signals for each of these audio channels for driving corresponding transducers in left and right loudspeaker arrays. In one embodiment, the content processor generates (1) first center audio signals for driving transducers in the left loudspeaker array to generate a first center directivity pattern, (2) second center audio signals for driving transducers in the right loudspeaker array to generate a second center directivity pattern, (3) left audio signals for driving transducers in the left loudspeaker array to generate a left directivity pattern, and (4) right audio signals for driving transducers in the right loudspeaker array to generate a right directivity pattern. In this embodiment, the first and second center directivity patterns collectively represent the center audio channel while the left and right directivity patterns respectively represent the left and right audio channels.

In one embodiment, the left, right, and center audio channels may be equalized or otherwise adjusted to abate auditory distortions. For example, in one embodiment a peak equalizer may be used for equalizing the center audio channel to eliminate a response dip caused by (1) the summation of the first and second center directivity patterns at the ears of the listener, (2) a delay caused by the separation of the left and right ears of the listener, and (3) sound diffraction and reflections about the head of the listener.

Using the system described above, a center audio channel may be accurately represented by using the left and right loudspeaker arrays. In particular, by driving each of the left and right loudspeaker arrays to generate (1) separate center directivity patterns that collectively represent the center audio channel and (2) separate left and right directivity patterns that represent left and right audio channels, respectively, the system described produces a center phantom image for a listener centered on its axis and in addition that center phantom image stays centered with off axis listening through amplitude-time trading that can be made to occur as a function of the polar pattern of the center directivity patterns of the left and right loudspeaker The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
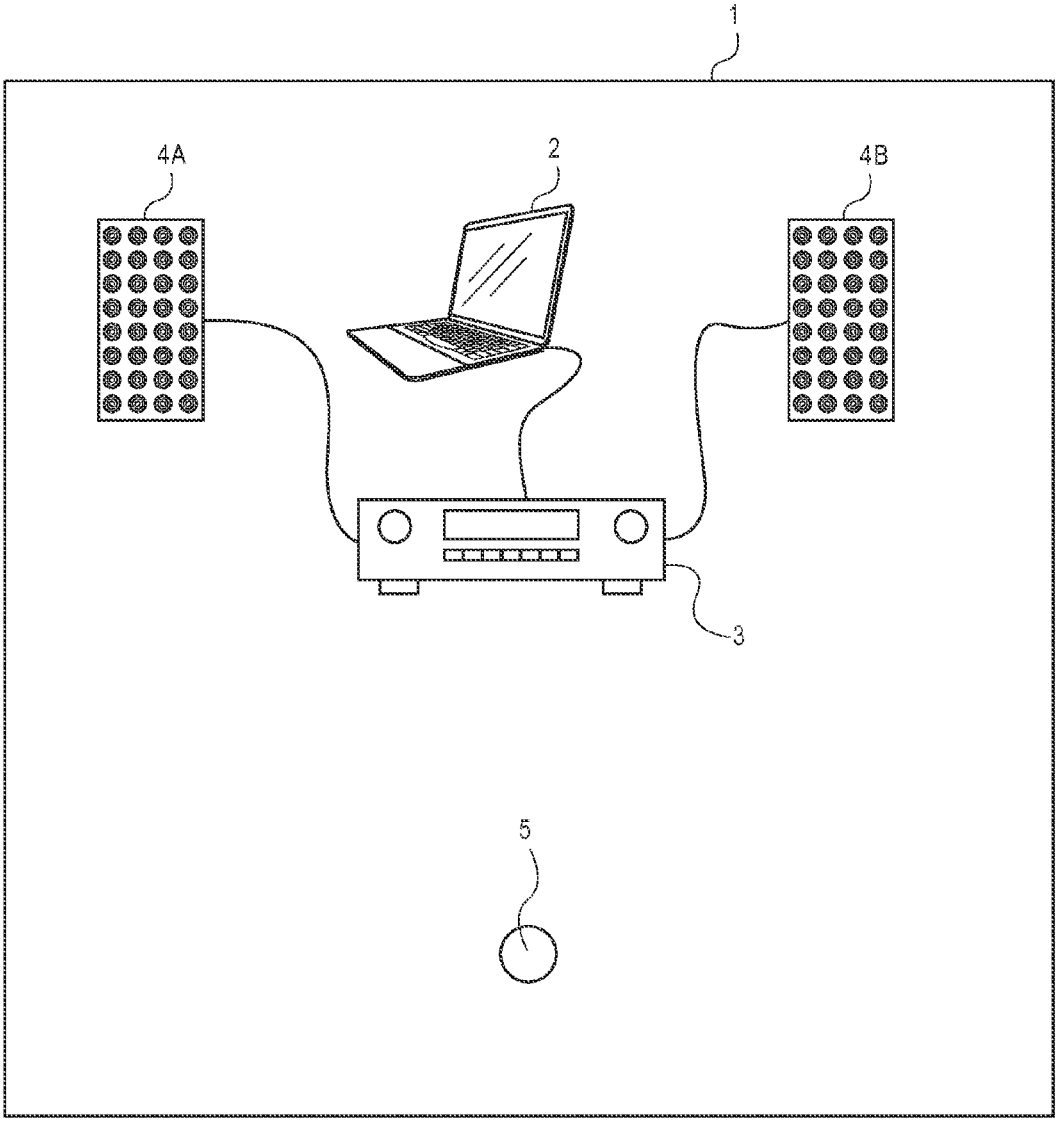
FIGS. 1A and 1B shows side views of listening areas with an audio output device, an audio receiver, and a set of loudspeaker arrays according to one embodiment.

FIG. 1A shows a side view of a listening area 1 with an audio output device 2, an audio receiver 3, and a set of loudspeaker arrays 4A and 4B. The audio output device 2, the audio receiver 3, and the loudspeaker arrays 4A and 4B may be coupled together such that sound program content played on the device 2 is used by the audio receiver 3 to drive the loudspeaker arrays 4A and 4B to emit corresponding sound patterns into the listening area 1.

As noted above, the loudspeaker arrays 4A and 4B emit sound into a listening area 1. The listening area 1 is a location in which the loudspeaker arrays 4A and 4B are located and in which a listener 6 is positioned to listen to sound emitted by the loudspeaker arrays 4A and 4B. For example, the listening area 1 may be a room within a house or commercial establishment or an outdoor area (e.g., an amphitheater).

Figure 1B:
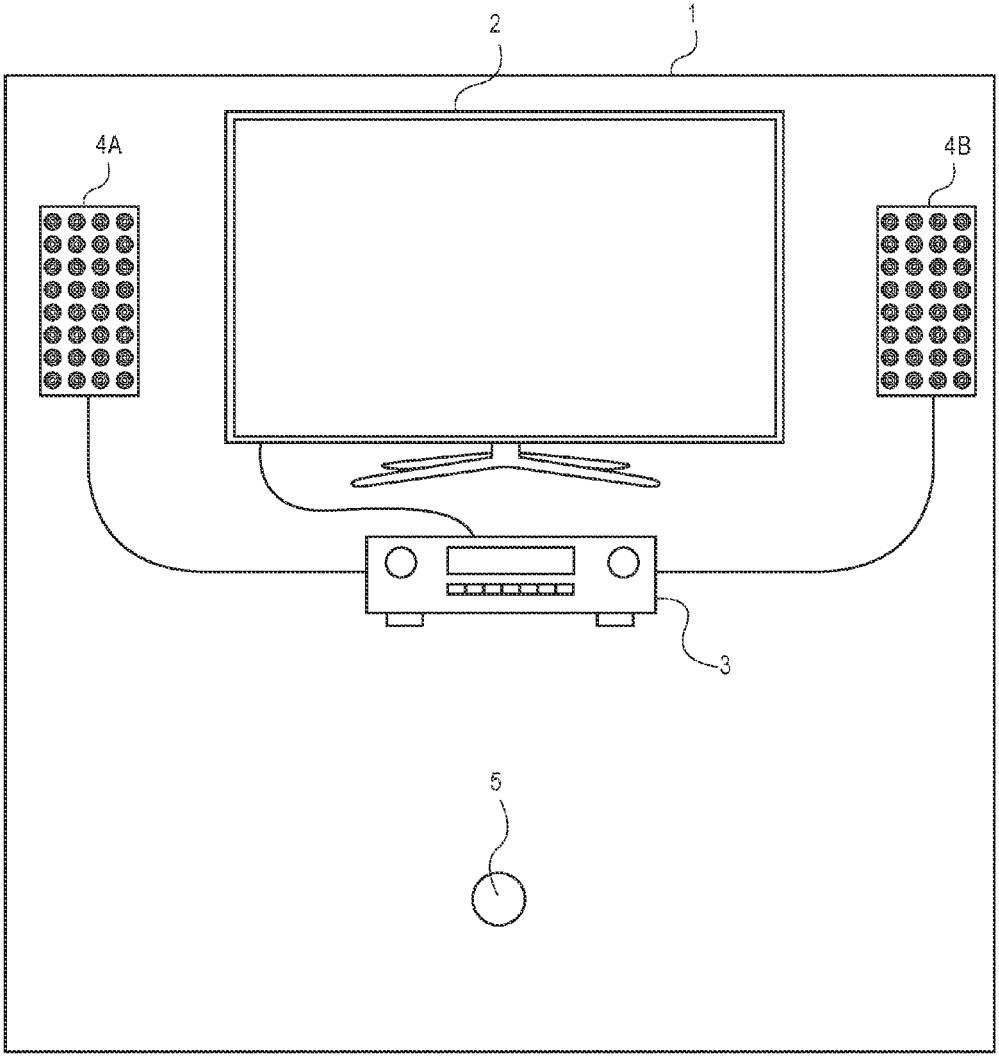

As shown in FIG. 1A, the audio output device 2 is a laptop computer; however, in other embodiments, the audio device 2 may be a television, a desktop computer, a netbook computer, a tablet computer, or a streaming network media player. For example, as shown in FIG. 1B, the audio output device 2 may be a television that outputs sound program content corresponding to a broadcast television show to the audio receiver 3. The audio receiver 3 drives the loudspeaker arrays 4A and 4B to produce sound patterns corresponding to one or more channels of the sound program (e.g., front left channel, front center channel, and front right channel). The sound program content corresponds to video displayed on a screen of the audio output device 2. In one embodiment, the screen for displaying video content is separate from the audio output device.

As shown in FIGS. 1A and 1B, the loudspeaker arrays 4A and 4B are coupled to the audio receiver 3 through the use of wires, possibly in conduit. In other embodiments, the loudspeaker arrays 4A and 4B are coupled to the audio receiver 3 using wireless protocols such that the arrays 4A and 4B and the audio receiver 3 are not physically joined but maintain a radio-frequency connection. For example, the loudspeaker arrays 4A and 4B may include WiFi receivers for receiving audio signals from a corresponding WiFi transmitter in the audio receiver 3. In some embodiments, the loudspeaker arrays 4A and 4B may include integrated amplifiers for driving transducers using the wireless signals received from the audio receiver 3.

In one embodiment, the loudspeaker arrays 4A and 4B are used to represent front left, front right, and front center audio channels. For example, the loudspeaker array 4A may emit sound to represent a front left audio channel, the loudspeaker array 4B may emit sound to represent a front right audio channel, and the loudspeaker arrays 4A and 4B may jointly emit separate sounds to represent a front center audio channel. A system and method for driving the loudspeaker arrays 4A and 4B according to this configuration will be described in further detail below.

Figure 2:
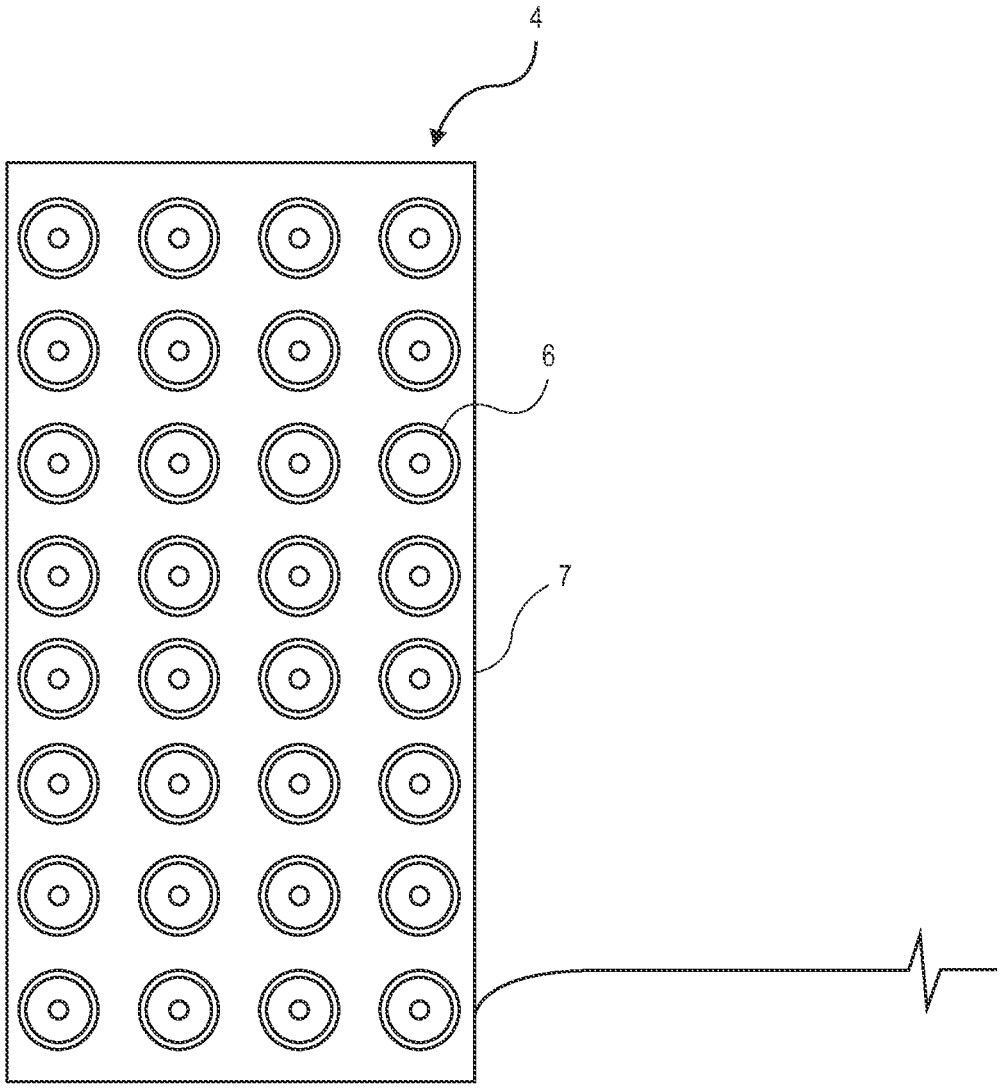
FIG. 2 shows one loudspeaker array with multiple transducers housed in a single cabinet according to one embodiment.

FIG. 2 shows one loudspeaker array 4 with multiple transducers 6 housed in a single cabinet 7. In this example, the loudspeaker array 4 has 32 distinct transducers 6 evenly aligned in eight columns within the cabinet 7. In other embodiments, different numbers of transducers 6 may be used with uniform or non-uniform spacing. The transducers 6 may be any combination of full-range drivers, mid-range drivers, subwoofers, woofers, and tweeters. Each of the transducers 6 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 6 magnetic system interact, generating a mechanical force that causes the coil (and thus, the attached cone) to move back and forth, thereby reproducing sound under the control of the applied electrical audio signal coming from an audio source, such as the audio receiver 3. Although electromagnetic dynamic loudspeaker drivers are described, those skilled in the art will recognize that other types of loudspeaker drivers, such as planar electromagnetic and electrostatic drivers are possible.

Each transducer 6 may be individually and separately driven to produce sound in response to separate and discrete audio signals received from an audio source (e.g., the audio output device 2 and/or the receiver 3). By allowing the transducers 6 in the loudspeaker array 4 to be individually and separately driven according to different parameters and settings (including delays and energy levels), the loudspeaker array 4 may produce numerous directivity patterns that accurately represent front left, right, and center channels of a piece of sound program content output by the audio output device 2. For example, the audio receiver 3 may employ amplitude, time, and frequency response shading as needed to produce various directivity patterns.

Figure 3:
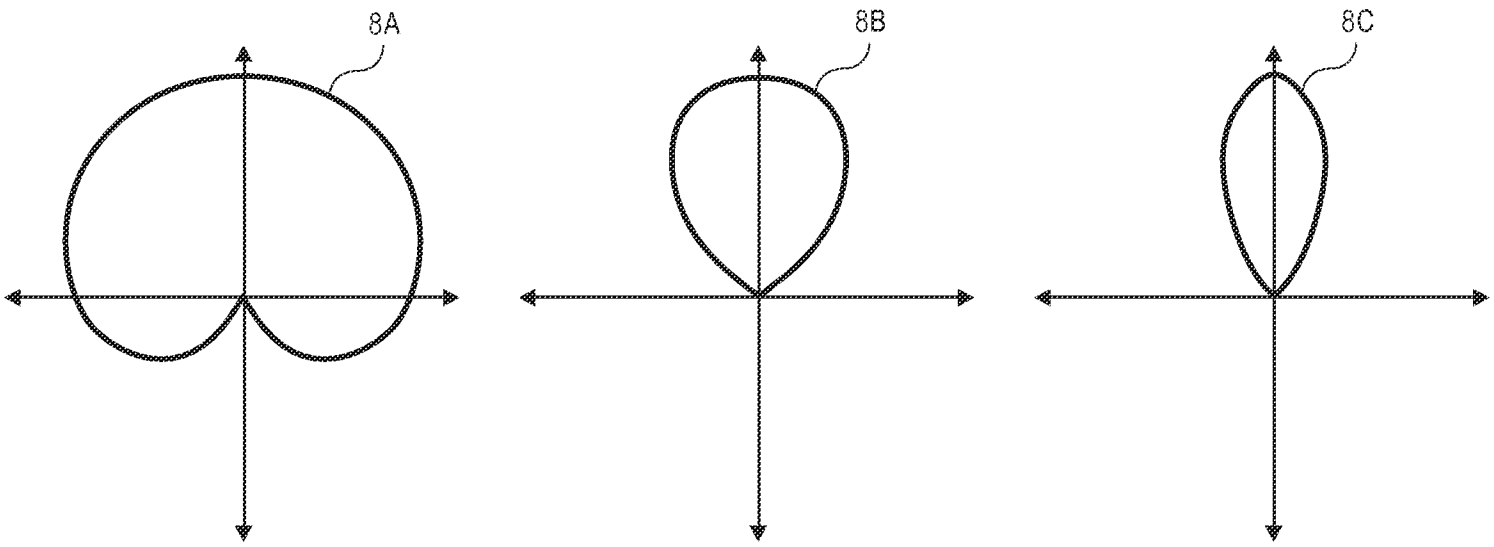
FIG. 3 shows three example directivity patterns that may be emitted by the loudspeaker arrays according to one embodiment.

FIG. 3 shows three example directivity patterns 8A, 8B, and 8C that may be emitted by the loudspeaker arrays 4A and 4B. The directivity patterns 8A, 8B, and 8C range in their levels of directivity from least to greatest. For example, directivity pattern 8A emits a lower ratio of direct sound at a target (e.g., the listener 5) in comparison to sound generally emitted into the listening area 1 than directivity patterns 8B and 8C. The directivity patterns 8A, 8B, and 8C are example patterns that may be emitted by the loudspeaker arrays 4A and 4B. In other embodiments, the loudspeaker arrays 4A and 4B may emit other directivity patterns. In one embodiment, the loudspeaker arrays 4A and 4B may have separate horizontal and vertical components such that the distribution of sound in the horizontal direction is different from the distribution of sound in the vertical direction.

Figure 4:
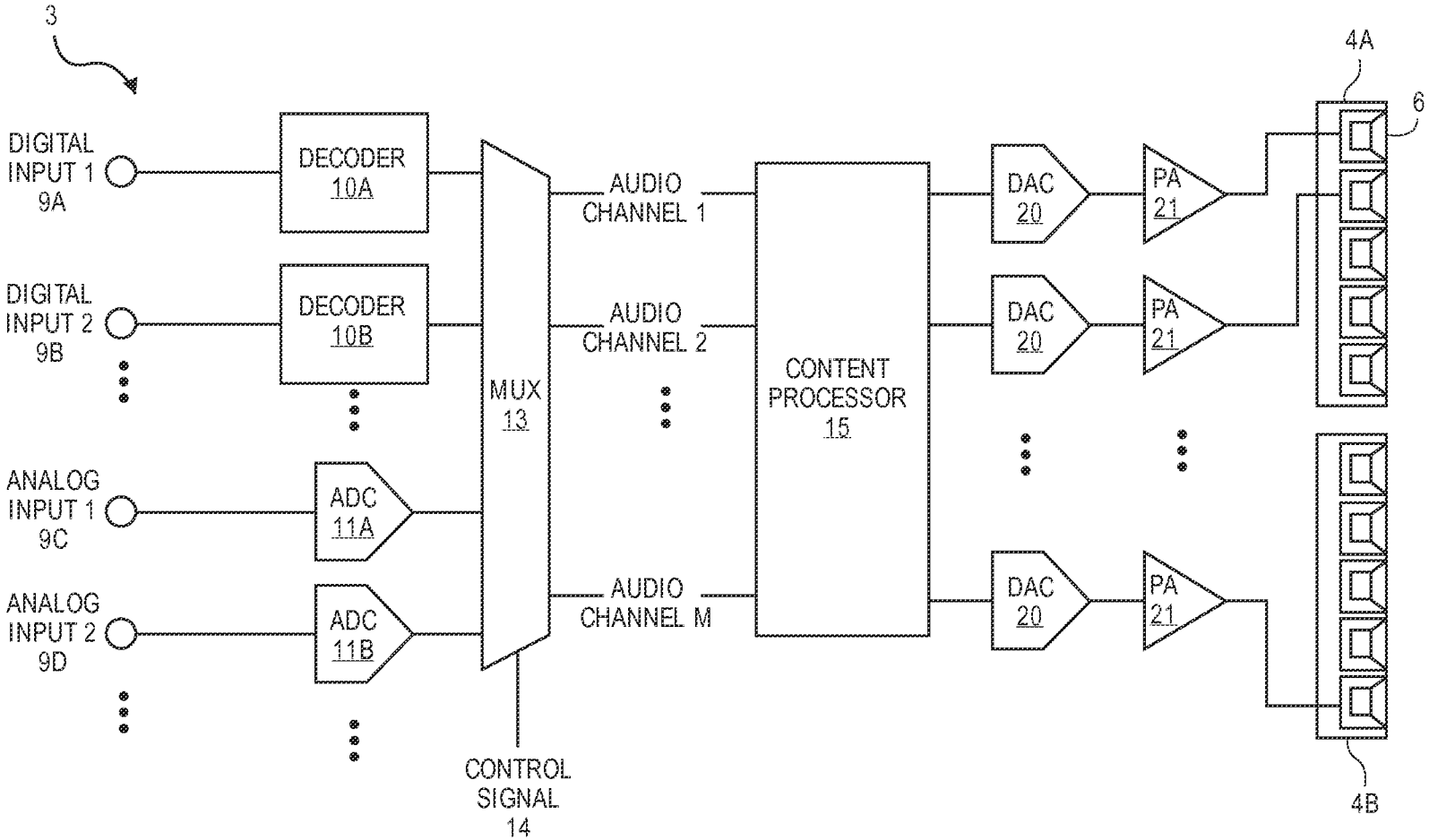
FIG. 4 shows a functional unit block diagram and some constituent hardware components of the audio receiver according to one embodiment.

FIG. 4 shows a functional unit block diagram and some constituent hardware components of the audio receiver 3 according to one embodiment. The components shown in FIG. 4 are representative of elements included in the audio receiver 3 and should not be construed as precluding other components. Although shown as being separate from the loudspeaker arrays 4A and 4B, in some embodiments, one or more components of the audio receiver 3 may be integrated within one or more of the loudspeakers 4A and 4B. Each element of audio receiver 3 will be described by way of example below.

The audio receiver 3 may include multiple inputs 9 for receiving pieces of sound program content using electrical, radio, or optical signals from the audio output device 2. The inputs 9 may be a set of digital inputs 9A and 9B and analog inputs 9C and 9D including a set of physical connectors located on an exposed surface of the audio receiver 3. For example, the inputs 9 may include a High-Definition Multimedia Interface (HDMI) input, an optical digital input (Toslink), and a coaxial digital input. In one embodiment, the audio receiver 3 receives audio signals through a wireless connection with the audio output device 2. In this embodiment, the inputs 9 include a wireless adapter for communicating with the audio output device 2 using wireless protocols. For example, the wireless adapter may be capable of communicating using BLUETOOTH, IEEE 802.11x, cellular Global System for Mobile Communications (GSM), cellular Code division multiple access (CDMA), or Long Term Evolution (LTE).

General signal flow from the inputs 9 will now be described. Looking first at the digital inputs 9A and 9B, upon receiving a digital audio signal through an input 9A or 9B, the audio receiver 3 uses a decoder 10A or 10B to decode the electrical, optical, or radio signals into a set of audio channels representing sound program content. For example, the decoder 10A may receive a single signal containing six audio channels (e.g., a 5.1 signal) and decode the signal into six audio channels. The decoder 10A may be capable of decoding an audio signal encoded using any codec or technique, including Advanced Audio Coding (AAC), MPEG Audio Layer II, and MPEG Audio Layer III.

Turning to the analog inputs 9C and 9D, each analog signal received by analog inputs 9C and 9D represents a single audio channel of the sound program content. Accordingly, multiple analog inputs 9C and 9D may be needed to receive each channel of sound program content. The audio channels may be digitized by respective analog-to-digital converters 11A and 11B to form digital audio channels.

The digital audio channels from each of the decoders 10A and 10B and the analog-to-digital converters 11A and 11B are output to the multiplexer 13. The multiplexer 13 selectively outputs a set of audio channels based on a control signal 14. The control signal 14 may be received from a control circuit or processor in the audio receiver 3 or from an external device. For example, a control circuit controlling a mode of operation of the audio receiver 3 may output the control signal 14 to the multiplexer 13 for selectively outputting a set of digital audio channels.

The multiplexer 13 feeds the selected digital audio channels to a content processor 15. The channels output by the multiplexer 14 are processed by the content processor 15 to produce a set of processed audio signals. The processing may operate in both or either of the time and frequency domains using transforms such as the Fast Fourier Transform (FFT). The content processor 15 may be a special purpose processor such as an application-specific integrated circuit (ASIC), a general purpose microprocessor, a field-programmable gate array (FPGA), a digital signal controller, or a set of hardware logic structures (e.g. filters, arithmetic logic units, and dedicated state machines).

As noted above, one or more components of the audio receiver 3 may be integrated into one or more of the loudspeaker arrays 4A and 4B. For example, a content processor 15 may be integrated into each of the loudspeaker arrays 4A and 4B, such that each of the loudspeaker arrays 4A and 4B are fed the selected digital audio channels and the selected digital audio channels are separately processed by corresponding content processors 15 in each array 4A and 4B.

The content processor 15 may perform various audio processing routines on the digital audio channels to adjust and enhance the sound program content in the channels. The audio processing may include directivity adjustment, noise reduction, equalization, and filtering.

In one embodiment, the content processor 15 drives the loudspeakers 4A and 4B to simultaneously and separately emit sound representing a front left audio channel, a front right audio channel, and a front center audio channel for the sound program content output by the audio output device 2. For example, the content processor 15 generates a set of front left signals, a set of front right signals, and a set of front center signals. In one embodiment, the front left signals are used to drive transducers 6 in the loudspeaker array 4A, the front right signals are used to drive transducers 6 in the loudspeaker array 4B, and the front center signals are used to drive transducers 6 in both of the loudspeaker arrays 4A and 4B. Based on this arrangement, the loudspeaker array 4A emits a directivity pattern using the front left signals representing a front left audio channel; the loudspeaker array 4B emits a directivity pattern using the front right signals representing a front right audio channel; while the loudspeaker arrays 4A and 4B collectively emit separate directivity patterns using the front center signals representing a front center audio channel. Each of the front left, front right, and front center signals may be separate and distinct such that the audio receiver 3 may drive the loudspeaker arrays 4A and 4B to independently produce left, right, and center channel content. This independence provides greater control and accuracy in producing each channel of the sound program content.

Figure 5:
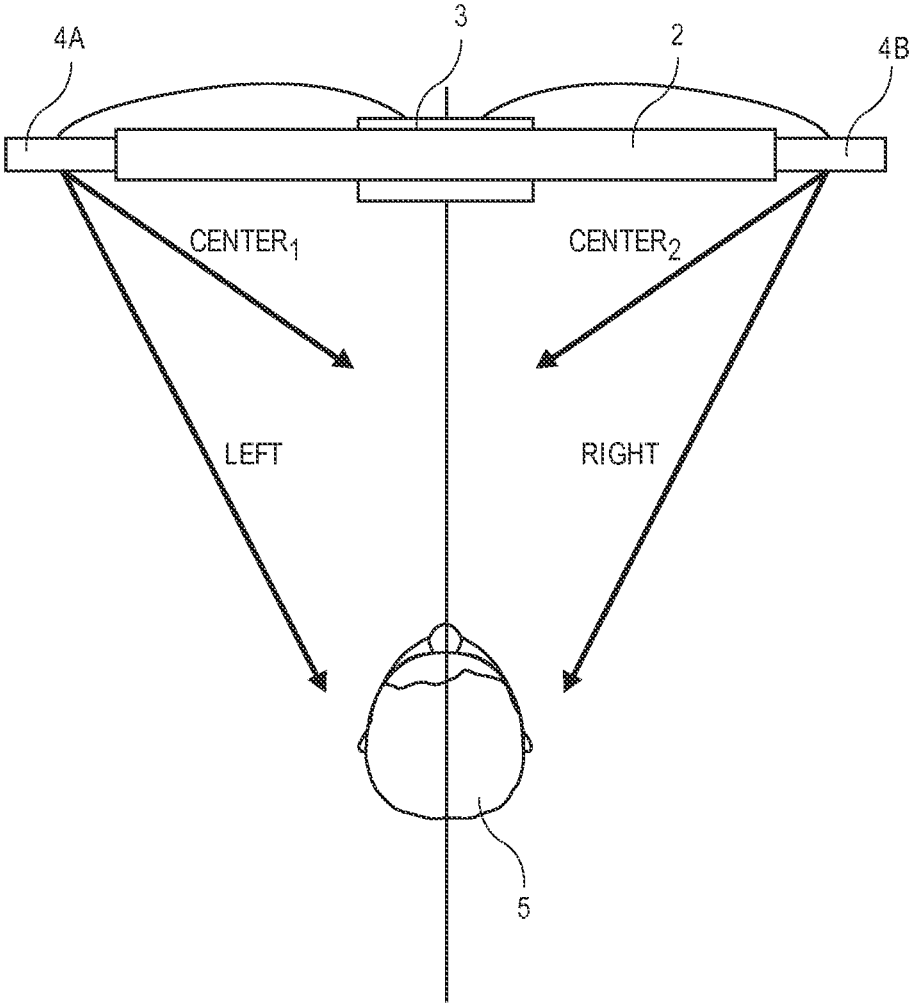
FIG. 5 shows the centerlines of a set of directivity patterns emitted by loudspeaker arrays to represent left, right, and center audio channels according to one embodiment.

As shown in FIG. 5, the audio receiver 3 may drive the loudspeaker arrays 4A and 4B to emit left and right directivity patterns corresponding to left and right channels for the sound program content, respectively. The loudspeaker array 4A further produces a left center directivity pattern and the loudspeaker array 4B produces a right center directivity pattern. The left center and right center patterns collectively form the front center audio channel for the sound program content.

Figure 6:
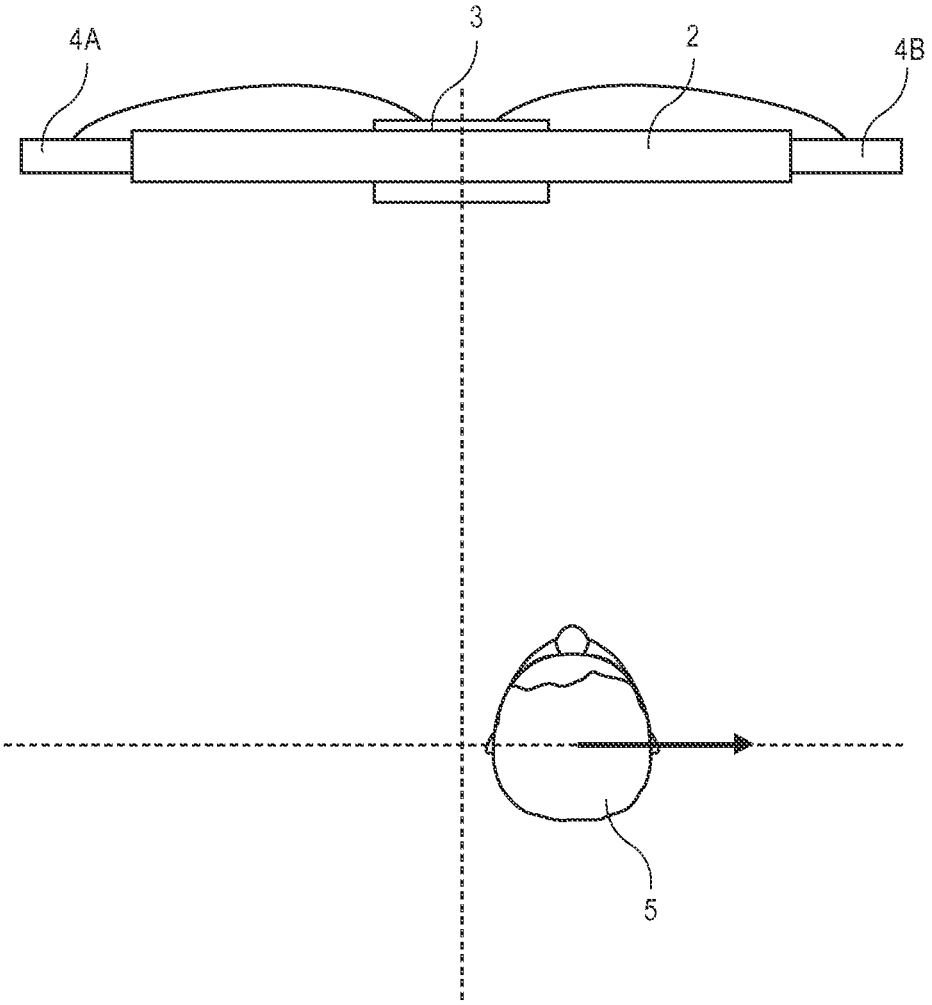
FIG. 6 shows a listener moving to the right towards the loudspeaker array according to one embodiment.
Figure 7:
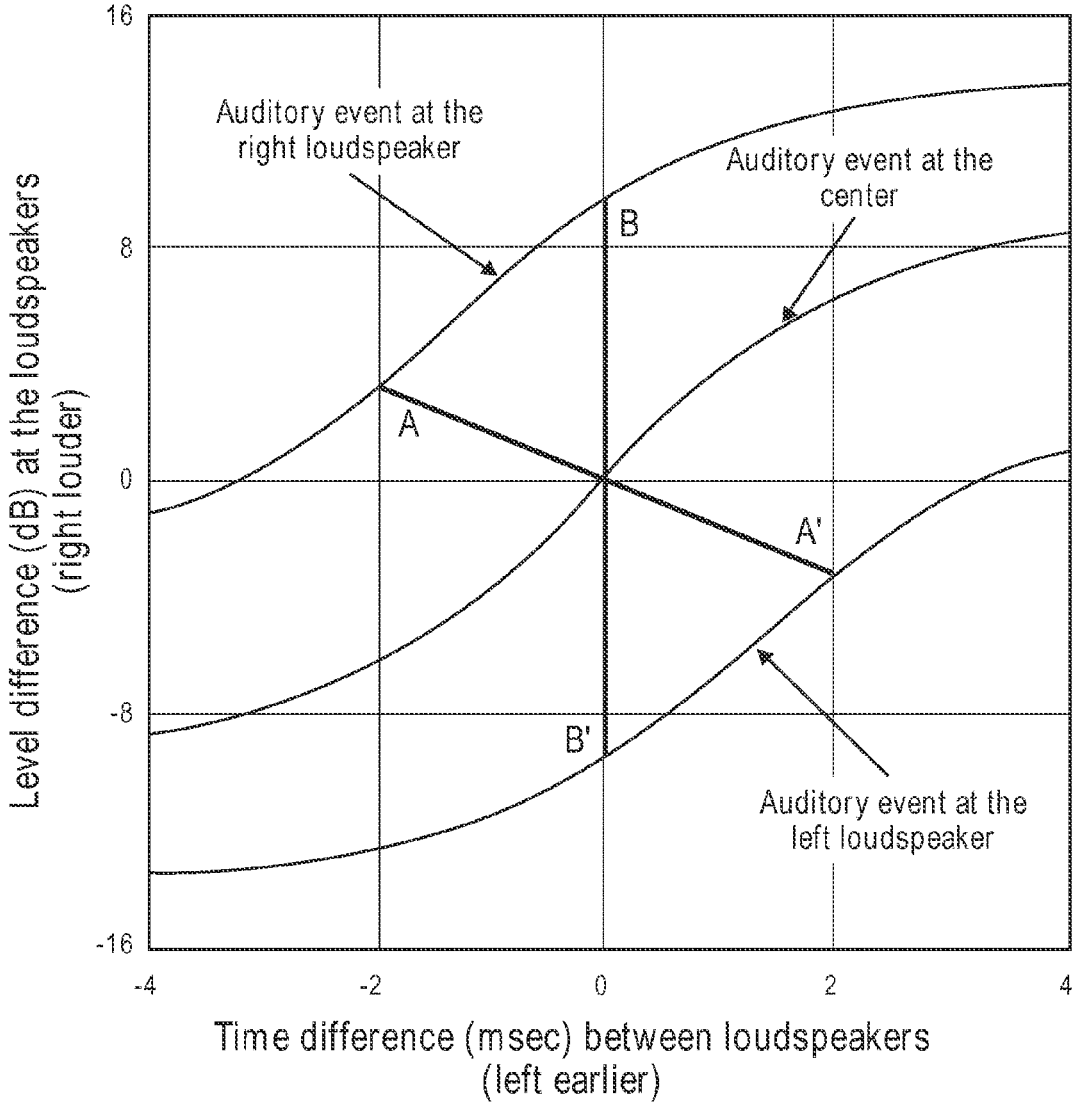
FIG. 7 shows a frequency/time trading curve used by the loudspeaker arrays to represent the center audio channel according to one embodiment.

To stabilize a center image from audio output device 2, the sound field produced for the center channel is warped from more or less half space radiation, which would occur with a loudspeaker 4 in a display placed against a wall or a loudspeaker 4 placed outside a picture within a tolerance, to a radiation pattern for the center channel content that only crosses over the opposing loudspeaker 4. For example, more sound from the right center and left center patterns are directed towards the opposing loudspeaker array 4A or 4B, respectively, than directly into the listening area 1 and at the listener 5. As the listener 5 moves along a line parallel to the loudspeaker arrays 4A and 4B, the sound level from the distant loudspeaker array 4A or 4B increases. For example, as shown in FIG. 6 as the listener 5 moves to the right towards the loudspeaker array 4B, the sound level from the left center pattern increases while the sound level from the right center pattern decreases. Conversely, as the listener 5 moves to the left towards the loudspeaker array 4A, the sound level from the right center pattern increases while the sound level from the left center pattern decreases. This frequency/time trading may be performed according to the graph in FIG. 7.

In one or more embodiments, a dip in response may occur as a result of (1) the summation at the ears of the listener 5 of sound from the left center and right center patterns producing a phantom center, (2) the delay caused by the separation of the left and right ears of the listener 5 (typically 200 μs), and/or (3) sound diffraction/reflection about the head and ears of the listener 5. In these embodiments, the content processor 15 may apply a peak equalizer that is equal and opposite to the response dip to the front center audio channel. Equalizing the front center audio channel in this fashion while together independently driving the loudspeaker arrays 4A and 4B to produce the front center audio channel and managing the direct to reverberant ratio as described above improves localization and intelligibility of the center audio channel.

As shown in FIG. 4, the processed audio signals representing the front left, front right, and front center audio channels of the sound program content are passed from the content processor 15 to one or more digital-to-analog converters 20 to produce one or more distinct analog signals. The analog signals produced by the digital-to-analog converters 20 are fed to the power amplifiers 21 to drive transducers 6 of the loudspeaker arrays 4A and 4B to produce the left, right, left center, and right center directivity patterns using separate level, time, and equalization parameters.

Using the system described above, a center audio channel may be accurately represented by using the left and right loudspeaker arrays 4A and 4B. In particular, by driving each of the left and right loudspeaker arrays 4A and 4B to generate (1) separate center directivity patterns that collectively represent the center audio channel and (2) separate left and right directivity patterns that represent left and right audio channels, respectively, the system described above minimizes the movement away from center of the center phantom image when the listener 5 moves around the listening area 1.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for driving left and right loudspeaker arrays to simulate a center audio channel for a piece of sound program content to a listener, comprising:

driving the left loudspeaker array to emit a first sound pattern into a listening area based on the center audio channel;

driving the right loudspeaker array to emit a second sound pattern into the listening area based on the center audio channel;

driving the left loudspeaker array to emit a third sound pattern into the listening area representing a left audio channel for the piece of sound program content; and driving the right loudspeaker array to emit a fourth sound pattern into the listening area representing a right audio channel for the piece of sound program content, wherein the first sound pattern produces a first sound level gradient wherein as the listener moves away from the left loudspeaker array sound level from the first sound pattern increases and sound level from the third sound pattern decreases, wherein the second sound pattern produces a second sound level gradient wherein as the listener moves away from the right loudspeaker array sound level from the second sound pattern increases and sound level from the fourth sound pattern decreases.

2. The method of claim 1, wherein the first sound pattern emits more sound at the right loudspeaker array in a horizontal plane than directly at the listener.

3. The method of claim 2, wherein the second sound pattern emits more sound at the left loudspeaker array in the horizontal plane than directly at the listener.

4. The method of claim 1, further comprising:

applying a peak equalizer to the center audio channel equal and opposite to a response dip caused by (i) summation of the first and second sound patterns at the ears of the listener, (ii) a delay caused by the separation of the left and right ears of the listener, and (iii) sound diffraction about the head and ears of the listener.

5. The method of claim 1, wherein the first sound pattern, the second sound pattern, the third sound pattern, and the fourth sound pattern deliver more direct than reflected sound to the listener in a vertical plane.

6. The method of claim 1, wherein the first and second sound patterns collectively represent the center audio channel.

7. An audio receiver for driving left and right loudspeaker arrays to simulate a center audio channel for a piece of sound program content to a listener, comprising:

a content processor to generate a left audio signal corresponding to a left audio channel for the sound program content, a right audio signal corresponding to a right audio channel of the sound program content, and separate first and second center audio signals for respectively driving the left and right loudspeaker arrays to collectively simulate the center audio channel, wherein the first and second center audio signals are separate from the left and right audio signals; and amplifiers to (1) drive transducers in the left loudspeaker array based on the first center audio signal to produce a first center directivity pattern and (2) drive transducers in the right loudspeaker array based on the second center audio signal to produce a second center directivity pattern, (3) drive transducers in the left loudspeaker array based on the left audio signal to produce a left directivity pattern and (4) drive transducers in the right loudspeaker array based on the right audio signal to produce a right directivity pattern, wherein the first center directivity pattern produces a first sound level gradient wherein as the listener moves away from the left loudspeaker array sound level from the first center directivity pattern increases and sound level from the left directivity pattern decreases, wherein the second center directivity pattern produces a second sound level gradient wherein as the listener moves away from the right loudspeaker array sound level from the second center directivity pattern increases and sound level from the right directivity pattern decreases.

8. The audio receiver of claim 7, wherein the first center directivity pattern emits more sound at the right loudspeaker array in a horizontal plane than directly at the listener.

9. The audio receiver of claim 8, wherein the second center directivity pattern emits more sound at the left loudspeaker array in the horizontal plane than directly at the listener.

10. The audio receiver of claim 7, further comprising:

a peak equalizer for equalizing the center audio channel to eliminate a response dip caused by (i) summation of the first and second center directivity patterns at the ears of the listener, (ii) a delay caused by the separation of the left and right ears of the listener, and (iii) sound diffraction about the head and ears of the listener.

11. An article of manufacture for driving left and right loudspeaker arrays to simulate a center audio channel for a piece of sound program content to a listener, comprising:

a non-transitory machine-readable storage medium that stores instructions which, when executed by a processor in a computer, cause the processor to drive the left loudspeaker array to emit a first sound pattern into a listening area based on the center audio channel;

drive the right loudspeaker array to emit a second sound pattern into the listening area based on the center audio channel, drive the left loudspeaker array to emit a third sound pattern into the listening area representing a left audio channel for the piece of sound program content; and drive the right loudspeaker array to emit a fourth sound pattern into the listening area representing a right audio channel for the piece of sound program content, wherein the first sound pattern produces a first sound level gradient wherein as the listener moves away from the left loudspeaker array sound level from the first sound pattern increases and sound level from the third sound pattern decreases, wherein the second sound pattern produces a second sound level gradient wherein as the listener moves away from the right loudspeaker array sound level from the second sound pattern increases and sound level from the fourth sound pattern decreases.

12. The article of manufacture of claim 11, wherein the first sound pattern emits more sound at the right loudspeaker array in a horizontal plane than directly at the listener.

13. The article of manufacture of claim 12, wherein the second sound pattern emits more sound at the left loudspeaker array in the horizontal plane than directly at the listener.

14. The article of manufacture of claim 11, wherein the storage medium includes further instructions to:

apply a peak equalizer to the center audio channel equal and opposite to a response dip caused by (i) summation of the first and second sound patterns at the ears of the listener, (ii) a delay caused by the separation of the left and right ears of the listener, and (iii) sound diffraction about the head and ears of the listener.

15. The article of manufacture of claim 11, wherein the first sound pattern, the second sound pattern, the third sound pattern, and the fourth sound pattern deliver more direct than reflected sound to the listener in the vertical plane.

16. A content processor for producing processed audio signals that drive left and right loudspeaker arrays to simulate a center audio channel, the content processor including programmed data processing components and fixed hard-wired circuit components to perform operations comprising:

generating a left center directivity pattern based on the center audio channel to drive the left loudspeaker array and emit a first sound pattern;

generating a right center directivity pattern based on the center audio channel to drive the right loudspeaker array and emit a second sound pattern;

generating a left directivity pattern based on the left audio channel to drive the left loudspeaker array to emit a third sound pattern; and generating a right directivity pattern based on the right audio channel to drive the right loudspeaker array to emit a fourth sound pattern;

wherein the first sound pattern produces a first sound level gradient such that sound level from the first sound pattern increases and sound level from the third sound pattern decreases as the listener moves away from the left loudspeaker array;

wherein the second sound pattern produces a second sound level gradient such that sound level from the second sound pattern increases and sound level from the fourth sound pattern decreases as the listener moves away from the right loudspeaker array.

17. The content processor of claim 16, wherein the left center directivity pattern and the right center directivity pattern collectively represent the center audio channel.

18. The content processor of claim 16, wherein the left center directivity pattern emits more sound directed towards the right loudspeaker array than directly at the listener, and the right center directivity pattern emits more sound directed towards the left loudspeaker array than directly at the listener.

19. The content processor of claim 16, wherein the operations further comprise:

applying a peak equalizer to the center audio channel equal and opposite to a response dip caused by (i) summation of the left center directivity pattern and the right center directivity pattern at the ears of the listener, (ii) a delay caused by the separation of the left and right ears of the listener, and (iii) sound diffraction about the head and ears of the listener.

20. The content processor of claim 16, wherein the left center directivity pattern, the right center directivity pattern, the left directivity pattern, and the right directivity pattern deliver more direct than reflected sound to the listener in a vertical plane.

* * * * *